United States Patent [19]

Johnson

[11] 3,936,903

[45] Feb. 10, 1976

[54] VACUUM CLEANER SUCTION TOOL

[75] Inventor: Robert Edward Johnson, St. Paul, Minn.

[73] Assignee: Whirlpool Corporation, Benton Harbor, Mich.

[22] Filed: June 3, 1974

[21] Appl. No.: 475,972

[52] U.S. Cl. ..... 15/331; 15/416

[51] Int. Cl.[2] ..... A47L 9/00

[58] Field of Search ..... 15/331, 402, 416, 418

[56] References Cited

UNITED STATES PATENTS

| | | | |
|---|---|---|---|
| 2,348,861 | 5/1944 | Smellie | 15/416 X |
| 2,953,808 | 9/1960 | Carmack | 15/416 X |
| 3,205,528 | 9/1965 | Fromknecht | 15/416 |
| 3,797,066 | 3/1974 | Zaidan | 15/402 X |

FOREIGN PATENTS OR APPLICATIONS

| | | | |
|---|---|---|---|
| 1,173,623 | 7/1964 | Germany | 15/416 |

*Primary Examiner*—Harvey C. Hornsby
*Assistant Examiner*—C. K. Moore
*Attorney, Agent, or Firm*—Wegner, Stellman, McCord, Wiles & Wood

[57] ABSTRACT

A vacuum cleaner suction tool including a nozzle provided with improved structure for selectively applying high suction to an edge portion of the nozzle such as for improved cleaning of corner and edge areas. The suction control includes a valve adjacent the suction outlet of the nozzle and an operator for selectively positioning the valve to provide selective control of the suction action in the nozzle.

13 Claims, 6 Drawing Figures

VACUUM CLEANER SUCTION TOOL

BACKGROUND OF THE INVENTION

1. Field of the Invention

This invention relates to vacuum cleaners and in particular to suction tools for use in vacuum cleaners.

2. Description of the Prior Art

In one conventional form of vacuum cleaner, a nozzle is provided at the end of a hollow tube, or wand, for applying suction to the surface to be cleaned and permitting dirt loosened from the surface to be sucked in by a stream of air drawn through the nozzle and tube to the dirt collecting receptacle of the vacuum cleaner. The conventional suction nozzle of this type is transversely elongated with the tube extending from the mid-portion thereof. Thus, in the conventional nozzle arrangement, maximum suction is applied at the mid-portion of the nozzle.

In another conventional form of vacuum cleaner a nozzle is provided with a motor driven rotary brush for agitating a carpet while applying suction to the surface to be cleaned and permitting dirt loosened from the surface to be sucked in by a stream of air drawn through the nozzle to the dirt collecting receptacle of the vacuum cleaner. The conventional nozzle of this type includes brush bearings and brush drive mechanism at the opposite ends of the nozzle.

One of the deficiencies of the conventional nozzle is its inability to efficiently suck dirt at the opposite edges of the nozzle. This presents a vexatious problem where the unit is being utilized to clean a floor surface adjacent a wall or other upright obstruction. Thus, conventionally, resort is had to bringing the nozzle to adjacent the wall with the direction of elongation thereof parallel to the wall surface requiring substantial repeated manipulation of the vacuum cleaner to effect the desired cleaning of the floor surface adjacent the wall. Such repeated manipulation presents the further problem of potential damage to the wall surfaces as the nozzle must be brought repeatedly directly up to the wall in effectively cleaning the entire floor surface edge.

A number of different suction nozzle devices have been developed in an attempt to solve this vexatious problem. Thus, as shown in U.S. Pat. No. 1,782,882 of S. H. Rippey, the nozzle is provided with means defining conduits extending to the opposite ends of the nozzle with the flow of air through the conduits being selectively blocked by a manipulatable valve and with the center portion of the nozzle remaining open at all times.

In the subsequent U.S. Pat. No. 1,895,584 of D. B. Replogle, an air cleaning tool is provided with an end closure means which is movable as a result of a downward pressure on the nozzle adjacent the side wheels to provide a controlled flow of air through the end openings. The wheels in the Replogle structure are disposed outwardly of the opposite ends of the nozzle, thereby preventing disposition of either nozzle end directly at a wall.

In U.S. Pat. No. 2,555,979 of G. E. Lofgren, a suction nozzle is shown having a valve for concentrating air flow at the end of the nozzle by varying the amount of closure of the mid-portion of the nozzle. At no time is the entire nozzle open to the tube.

In L. A. Wolf U.S. Pat. No. 3,550,183, a vacuum cleaner cleaning tool is shown having passages leading to the front corners of the nozzle. No means is provided for selectively controlling the relative air flow between the different portions of the nozzle inlet opening.

In R. D. Hill et al U.S. Pat. No. 3,377,647, a crack cleaning suction attachment is illustrated wherein an auxiliary suction duct is provided having a portion connected to the internal suction system of the vacuum cleaner and a forward end portion provided with a suction tip. Means are provided for removably mounting the suction tip at one side of the main suction head of the vacuum cleaner. The coupling portion is inserted through a valve port so as to open the normally closed port and permit suction to be applied through the attachment from the main suction fan means of the vacuum cleaner. Thus, both the main suction and auxiliary suction means have suction simultaneously applied thereto by the fan.

SUMMARY OF THE INVENTION

The present invention comprehends as improved vacuum cleaner suction tool including means for sucking dirt-laden air through different inlet portions of the nozzle under the selective control of the operator.

More specifically, the invention comprehends providing means for selectively directing high suction to an edge portion of the nozzle for improved edge cleaning by the vacuum cleaner. In the illustrated embodiment, the edge suction means comprises a duct extending from an edge portion of the nozzle inlet to the suction outlet portion of the nozzle. The main suction air flow is provided through the mid-portion of the nozzle inlet to the suction outlet and is utilized in the normal cleaning operation. When it is desired to provide high edge suction cleaning action, a valve is manipulated by the operator to restrict the air flow from the mid-portion of the nozzle and provide substantially unrestricted flow from the edge portion to the nozzle suction outlet.

The duct means for conducting the air flow from the nozzle inlet air portion may be defined in part by the bottom plate of the vacuum cleaner. The valve means at the suction outlet is arranged to selectively control an opening from the duct means to the suction outlet and an opening from the mid-portion of the nozzle to the suction outlet.

In the illustrated embodiment, the valve means comprises a flap valve which is selectively swung to extend across either of the two openings to the suction outlet. In the arrangement wherein the valve extends across the opening from the mid-portion of the suction inlet, a small preselected minimum air flow is maintained so as to prevent clogging of the main portion of the nozzle such as by continued operation of the brush. At the same time, the duct is maintained substantially unrestricted so as to provide substantially maximum suction edge cleaning.

In the arrangement wherein the valve closes the opening from the duct to the suction outlet, the duct opening is substantially fully closed so that maximum air flow is obtained through the main, mid-portion of the suction inlet.

The valve is selectively operated by lever arrangement including a manual operating portion extending outwardly of the nozzle. Suitable interconnecting means are provided for swinging the valve as a result of selective movement of the operating handle.

In the illustrative embodiment, the valve is pivotally mounted to an end portion of the duct which cooperates with other wall means of the nozzle to define the wall of the suction outlet. The duct and suction wall means effectively define the openings to the suction outlet as discussed above.

The edge suction means is mounted to the nozzle for maintained association therewith. Thus, the present invention comprehends an improved suction control means which, while being extremely simple and economical, provides the highly desirable features discussed above.

BRIEF DESCRIPTION OF THE DRAWINGS

Other features and advantages of the invention will be apparent from the following description taken in connection with the accompanying drawing wherein.

DESCRIPTION OF THE PREFERRED EMBODIMENT

Figure 1:
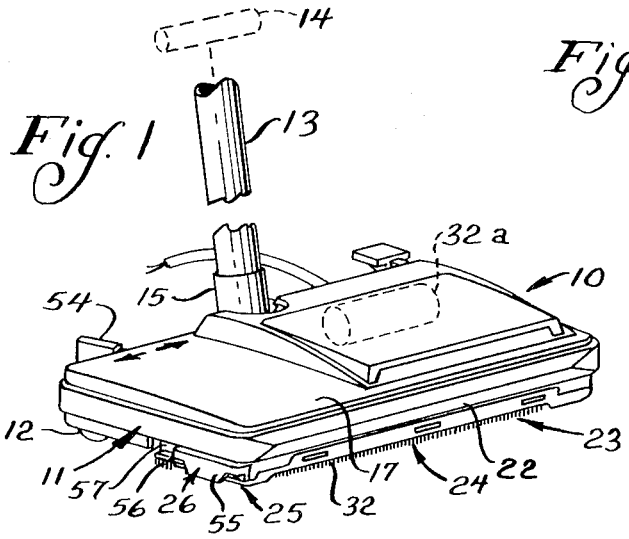
FIG. 1 is a fragmentary perspective view of a vacuum cleaner having a suction control means embodying the invention.

In the exemplary embodiment of the invention as disclosed in the drawing, a vacuum cleaner generally designated 10 is shown to comprise a nozzle generally designated 11 provided with suitable wheels 12 for movement over a floor surface to be cleaned. Movement of the wheeled nozzle is effected by manipulation of a tubular wand 13. Suction is applied through the wand 13 from a suitable suction fan 14 which may be disposed remotely and provided with suitable bag means for collecting the entrained dirt such as a conventional canister vacuum unit. Wand 13 includes a flexible connecting portion 15 connected to a suction outlet fitting 16 carried by the nozzle 11.

Figure 3:
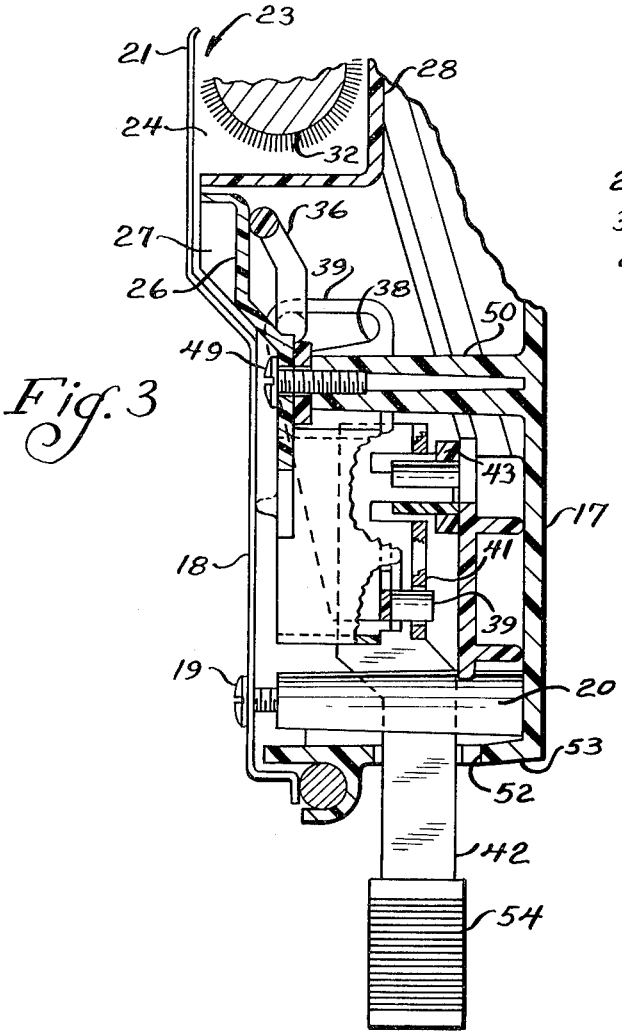
FIG. 3 is a fragmentary vertical section thereof taken substantially along the line 3—3 of FIG. 2.

As shown in FIGS. 1 and 3, nozzle 11 is defined by an upper housing portion 17 and a lower base plate 18 removably secured to the upper portion by suitable means, such as screws 19, having threaded engagement with mounting post 20 of the nozzle.

The forward portion 21 of the bottom plate defines, with a forward wall portion 22 of the nozzle, a suction inlet 23 which includes a mid-portion 24 and a side edge portion 25. A duct element 26 cooperates with the bottom plate 18 to define an edge suction passage 27 leading from inlet edge portion 25 to the suction outlet 16. Nozzle 11 further includes a removable wall portion 28 which defines the rear wall of the nozzle inlet mid-portion 24. A rotatable brush 32 driven by a motor **32*a* mounted within housing 17 is provided to extend along suction inlet 23** in a conventional manner.

Figure 4:
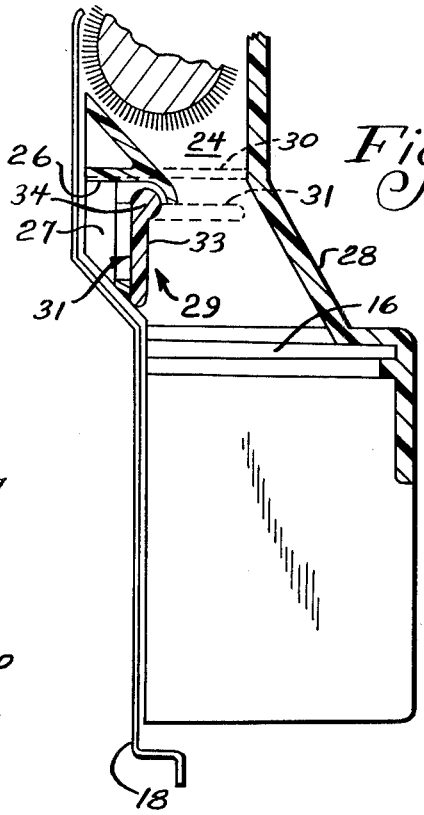
FIG. 4 is a fragmentary vertical section thereof taken substantially along the line 4—4 of FIG. 2.

As best seen in FIG. 4, duct element 26 defines a first opening 29 adjacent suction outlet 16 and cooperates with wall portion 28 to define a second opening 30. Opening 29 defines the opening from duct 26 to the suction outlet, and opening 30 defines the opening from the mid-portion 24 of the suction inlet 23 to the suction outlet 16.

The present invention comprehends a valve generally designated 31 for selectively controlling the openings 29 and 30 for improved control of the suction action in vacuum cleaner 10. Thus, as shown in FIG. 4 in a first, full line position of the valve 31, the opening 29 from duct passage 27 is effectively closed while the opening 30 from the inlet mid-portion 24 is substantially fully open for unrestricted suction from the inlet portion 24 to the suction outlet 16. In a second, dotted line position of FIG. 4, valve 31 extends across the opening 30 to substantially restrict air flow from inlet portion 24 to suction outlet 16 while providing substantially unrestricted air flow through opening 29 of duct passage 27 to the suction outlet 16. The valve is arranged to provide a preselected small amount of air flow through opening 30 in the second position so as to carry away any small amount of material which may be loosened by the revolving brush element 32 extending across suction inlet 23.

Figure 2A:
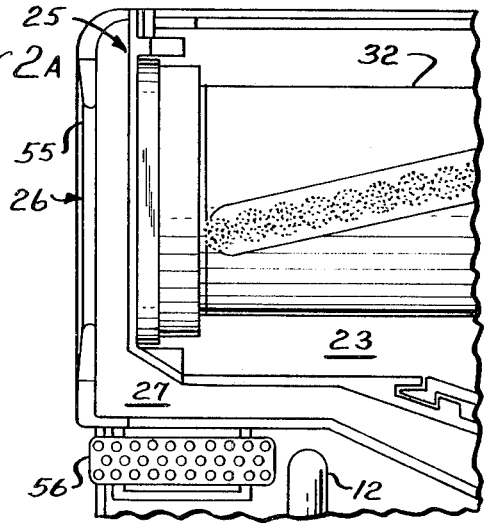
FIG. 2A is a fragmentary enlarged bottom plan view comprising an extension of the upper lefthand portion of FIG. 2.
Figure 2:
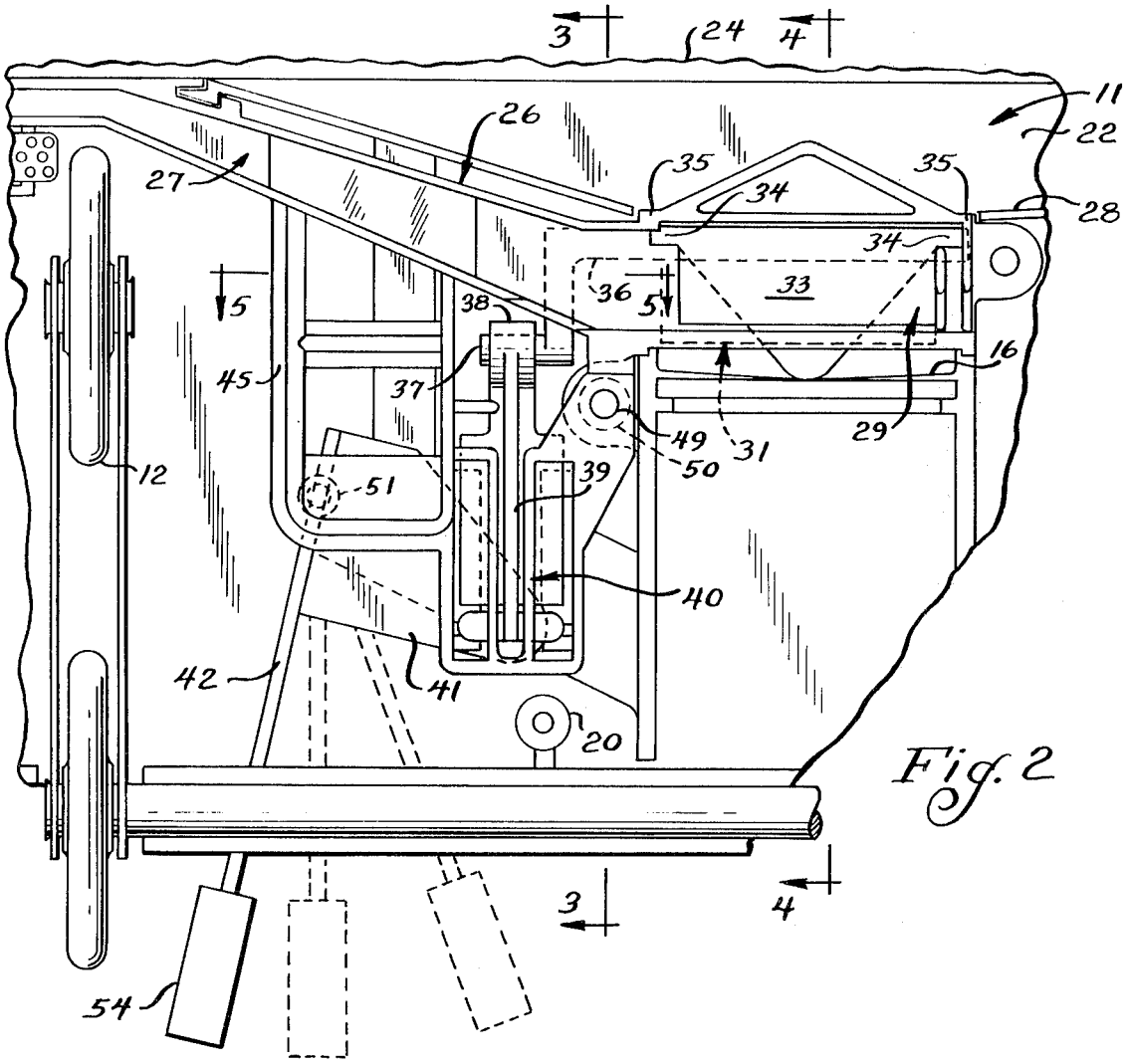
FIG. 2 is a fragmentary enlarged bottom plan view thereof with the base plate removed.
Figure 5:
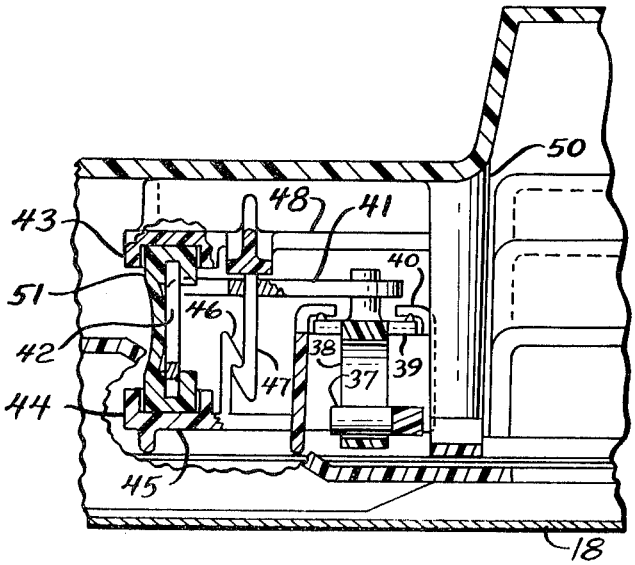
FIG. 5 is a fragmentary vertical section thereof taken substantially along the line 5—5 of FIG. 2.

As best seen in FIGS. 2 and 5, valve 31 comprises a flap valve having a closure portion 33, and pivot portions 34 pivotally mounted to the duct wall 26 at spaced journal portions 35. Extending from valve portion 33 is a connector portion 36 defining a crank arm having an end portion 37 movably received in a connector slot 38 of a slide 39 received in a guide 40. Slide 39 is rectilinearly reciprocated in guide 40 by a connecting arm 41 fixed to one end of an operating lever 42 pivotally mounted to a pivot bearing 43 on the nozzle and a cooperating pivot bearing 44 carried by the duct 26. The rectilinear movement of guide causes pivotal movement of closure portion 33 through the movement of end portion 37 in slot 38. Guide 40 may be formed integral with duct 26. A frame portion 45 connects the bearing 44 to the duct 26 and is provided with a suitable latch 46 releasably engaging a catch 47 on a portion 48 of nozzle wall 28. A screw 49 may further be provided for securing the guide portion 40 to a support post 50 and thereby removably securing the duct 26 to the nozzle. As shown in FIG. 5, bearing 44 may comprise an integral extension of guide 40 and bearing 43 may comprise an integral extension of wall portion 48.

A pivot element 51 may be fixed to the lever 42 for journalling the lever for rotation about a vertical axis on the bearings 43 and 44, as shown in FIG. 5. As shown in FIGS. 2 and 3, the lever 42 extends rearwardly through an opening 52 in the rear wall 53 of the upper housing portion 17 and is provided at its distal end with a tab portion 54 adapted to be engaged by the user's hand or foot in swinging the lever 42 to different positions about the vertical axis of bearings 43 and 44. As best seen in FIGS. 2 and 5, the swinging of lever 42 pivots connecting arm 41 so as to move the slide 39 in guide 40 and thereby, in turn, swing the end portion of the crank arm 36 about the axis of the pivot portion 34 of valve 31 for selectively positioning the valve across the openings 29 and 30 as discussed above.

Duct 26 includes a forward portion 55, as shown in FIG. 1, opening to the edge portion 25 of inlet 23. A suitable comb 56 is provided rearwardly of portion 55 for loosening tuft material adjacent the duct inlet 55 as the vacuum cleaner is moved back and forth on the surface to be cleaned. Comb 56 may be removably secured to a housing portion 57 defined by the duct element 26 for facilitated cleaning and replacement as desired. In the illustrated embodiment, duct portion 55 is disposed laterally of the bottom plate 18 so as to define a downwardly opening inlet to the duct passage 27, thereby effectively comprising the edge portion 25 of the nozzle inlet 23.

The operation of the improved suction control of the present invention is extremely simple. The user need merely adjust the lever 42 to the desired position for selectively positioning the closure portion 33 of valve 31 across opening 29 or opening 30 as desired. As discussed above, by disposing the valve across opening 30, high suction force is applied through the duct passage 27 to the edge inlet portion 25 whereby improved cleaning action is effected at the edge of the vacuum cleaner nozzle. At the same time, a small flow of air is maintained through the inlet mid-portion 24 to maintain the portion 32 free of entrained matter.

In the first position shown in full lines in FIG. 2, the valve portion 33 is extended across the opening 29 so as to effectively prevent air flow through the duct passage 27 while providing maximum unrestricted flow from the mid-portion 24 of inlet 23 to the suction outlet 16 for normal use of the vacuum cleaner.

The foregoing disclosure of specific embodiments is illustrative of the broad inventive concepts comprehended by the invention.

Having thus described the invention, the embodiments of the invention in which an enclusive property or privilege is claimed are defined as follows:

1. In a vacuum cleaner having a nozzle defining a suction passage having an inlet and an outlet, and means for sucking dirt laden air through said inlet to said outlet, said inlet of the nozzle defining a mid-portion and an edge portion, an improved means for controlling the suction of the dirt laden air through said inlet portions comprising: duct means extending from said edge portion of the nozzle inlet to said outlet; valve means at said outlet selectively movable between a first position and a second position, said valve means in said first position restricting air flow through said duct to said outlet while permitting unrestricted air flow from said mid-portion of the nozzle inlet to said outlet; means cooperating with said valve means for causing said valve means in said second position to permit unrestricted air flow through said duct while concurrently providing a preselected reduced air flow from said mid-portion of the nozzle inlet to said outlet and preventing full shutoff of said air flow from said mid-portion of the nozzle inlet to said outlet, said reduced air flow being substantially less than said unrestricted air flow through said duct; and means for selectively moving said valve means to said first and second positions.

2. The vacuum cleaner suction control means of claim 1 wherein said valve means is arranged to selectively substantially fully block said duct in said first position.

3. The vacuum cleaner suction control means of claim 1 wherein said nozzle includes a removable base plate defining a boundary wall of said suction passage mid-portion and edge portions.

4. The vacuum cleaner suction control means of claim 1 wherein said duct includes a removable portion providing selective cleaning access thereto.

5. The vacuum cleaner suction control means of claim 1 further including comb means adjacent said inlet edge portion.

6. The vacuum cleaner suction control means of claim 1 further including comb means fixedly mounted to said duct means adjacent said inlet edge portion.

7. In a vacuum cleaner having a nozzle defining a suction passage having an inlet and an outlet, a rotatably driven surface agitating brush positioned in said suction inlet, and means for sucking dirt laden air through said outlet, said inlet of the nozzle defining a mid-portion and an edge portion, and said outlet of the nozzle defining spaced, adjacent openings, an improved means for controlling the suction of the dirt laden air from said inlet portion through said outlet openings comprising: duct means extending from said edge portion of the nozzle inlet to one of said outlet openings; means for conducting air from said inlet mid-portion to the other of said outlet openings; valve means for controlling said outlet openings for selectively (a) restricting air flow through said one outlet opening while concurrently permitting substantially unrestricted air flow through said other outlet opening from said inlet mid-portion, and (b) permitting unrestricted air flow through said duct; means associated with said valve means for effectively positively preventing full shutoff of said air flow from said inlet mid-portion when said valve means is selectively arranged to permit unrestricted air flow through said duct thereby to assure at least a limited air flow from said inlet mid-portion at all times during the operation of the vacuum cleaner, said limited air flow being substantially less than said unrestricted air flow through said duct; and valve operator means for selectively positioning said valve means.

8. The vacuum cleaner suction control means of claim 7 wherein said outlet defines a pair of angularly related wall portions, said one outlet opening being disposed in one of said wall portions and said other outlet opening being disposed in the other of said wall portions adjacent said one opening, and said valve means comprises a flap valve swingable between a first position across said one outlet opening to a second position across said other outlet opening.

9. The vacuum cleaner suction control means of claim 7 wherein said outlet defines a pair of angularly related wall portions, said one outlet opening being disposed in one of said wall portions and said other outlet opening being disposed in the other of said wall portions adjacent said one opening, and said valve means comprises a flap valve swingable between a first position across said one outlet opening to a second position across said other outlet opening, said valve operator means being pivotally mounted to said nozzle and including an operator handle exposed outwardly of said nozzle for selectively swinging said flap valve to said positions.

10. The vacuum cleaner suction control means of claim 7 wherein said outlet defines a pair of angularly related wall portions, said one outlet opening being disposed in one of said wall portions and said other outlet opening being disposed in the other of said wall portions adjacent said one opening, and said valve means comprises a flap valve swingable between a first position across said one outlet opening to a second position across said other outlet opening.

11. The vacuum cleaner suction control means of claim 7 wherein said outlet defines a pair of angularly related wall portions, said one outlet opening being disposed in one of said wall portions and said other outlet opening being disposed in the other of said wall portions adjacent said one opening, and said valve means comprises a flap valve swingable between a first position across said one outlet opening to a second position across said other outlet opening, said valve being arranged to substantially fully block said duct in said one portion.

12. The vacuum cleaner suction control means of claim 7 wherein said outlet defines a pair of angularly related wall portions, said one outlet opening being disposed in one of said wall portions and said other outlet opening being disposed in the other of said wall portions adjacent said one opening, and said valve means comprises a flap valve swingable between a first position across said one outlet opening to a second position across said other outlet opening, said wall portions being integral with said duct.

13. The vacuum cleaner suction control means of claim 7 wherein said outlet defines a pair of angularly related wall portions, said one outlet opening being disposed in one of said wall portions and said other outlet opening being disposed in the other of said wall portions adjacent said one opening, and said valve means comprises a flap valve swingable between a first position across said one outlet opening to a second position across said other outlet opening, said valve being swingably mounted to said duct.

* * * * *